United States Patent [19]

Nes

[11] 4,121,892

[45] Oct. 24, 1978

[54] HOLDER FOR LOOSE FILING SHEETS

[76] Inventor: Per Sigurd Nes, Akerbyvagen 308, S-183 35 Täby, Sweden

[21] Appl. No.: 730,992

[22] Filed: Oct. 8, 1976

[51] Int. Cl.[2] ..... B42F 1/10; B42F 13/10

[52] U.S. Cl. ..... 402/17; 24/16 PB

[58] Field of Search ..... 402/14, 15, 16, 17; 24/16 PB

[56] References Cited

U.S. PATENT DOCUMENTS

| | | | |
|---|---|---|---|
| 1,850,376 | 3/1932 | Brennan | 402/17 |
| 2,119,843 | 6/1938 | Brennan | 402/17 |
| 2,536,792 | 1/1951 | Wendt | 402/15 |
| 3,019,486 | 2/1962 | Stinson | 281/37.5 |
| 3,285,251 | 11/1966 | Ivory et al. | 402/17 |
| 3,747,164 | 7/1973 | Fortsch | 24/16 PB |

FOREIGN PATENT DOCUMENTS

| | | | |
|---|---|---|---|
| 160,294 | 12/1954 | Australia | 402/17 |
| 807,326 | 10/1936 | France | 402/17 |
| 1,536,697 | 4/1970 | Fed. Rep. of Germany | 402/14 |
| 1,368,407 | 9/1974 | United Kingdom | 402/15 |
| 1,427,335 | 3/1976 | United Kingdom | 402/8 |

*Primary Examiner*—Jerome Schnall

*Attorney, Agent, or Firm*—Young & Thompson

[57] ABSTRACT

A holder for sheets such as sheets of paper with at least a pair of holes along one edge portion for receiving a pair of flexible locking tongues, which are made integral with a plastic strip having slits corresponding to the shape of the tongues for allowing the formation of the tongues, the latter being intended for bending up to a position substantially at right angles to the strip for introduction into the holes of the sheet, and into the appropriate openings of a locking strip having a bottom wall and side walls, for thereafter bending down over the bottom wall. A pair of riders are displaceable along the locking strip subsequently being moved into a position one over either tongue, for retaining it in a downwardly bent position. On its underside intended to be facing towards the bottom wall of the locking strip, each locking tongue is provided with locking teeth intended to engage with complementary locking teeth formed in the bottom wall of the locking strip. The distance between the bottom wall of the locking strip against which the tongue engages, and the underside of each rider is approximately equal to the thickness of the tongue so that the tongue is kept pressed against the locking strip for maintaining engagement between the locking teeth when the rider has been pushed over the respective tongue.

1 Claim, 21 Drawing Figures

Figure 6:
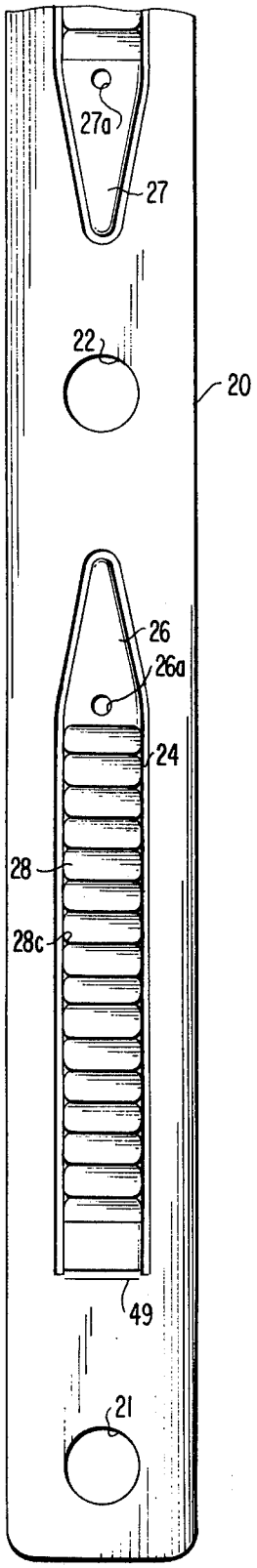

FIG. 1
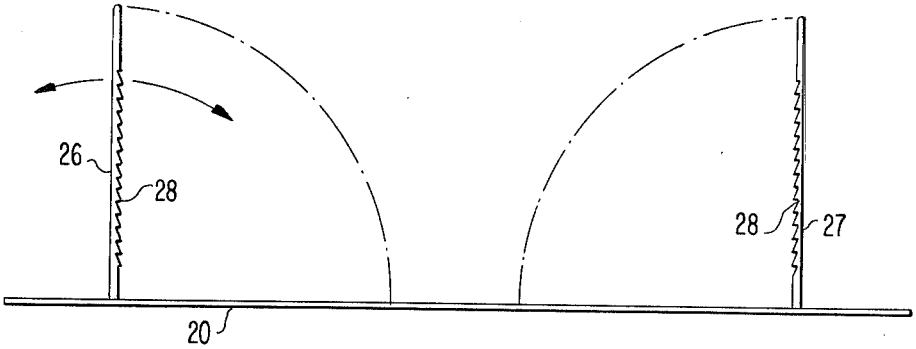
FIG. 2
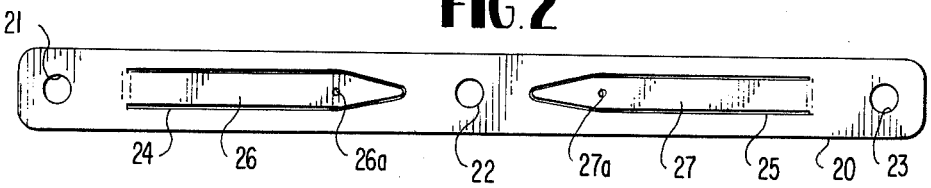
FIG. 3
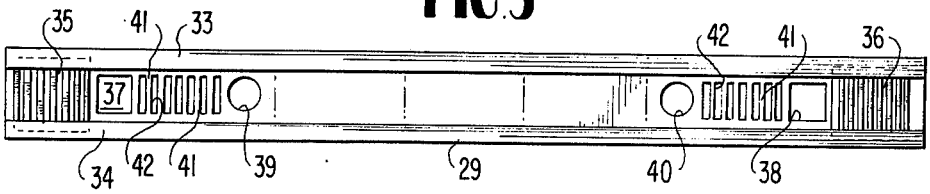
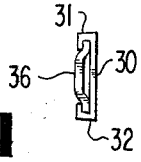
FIG. 4
FIG. 5
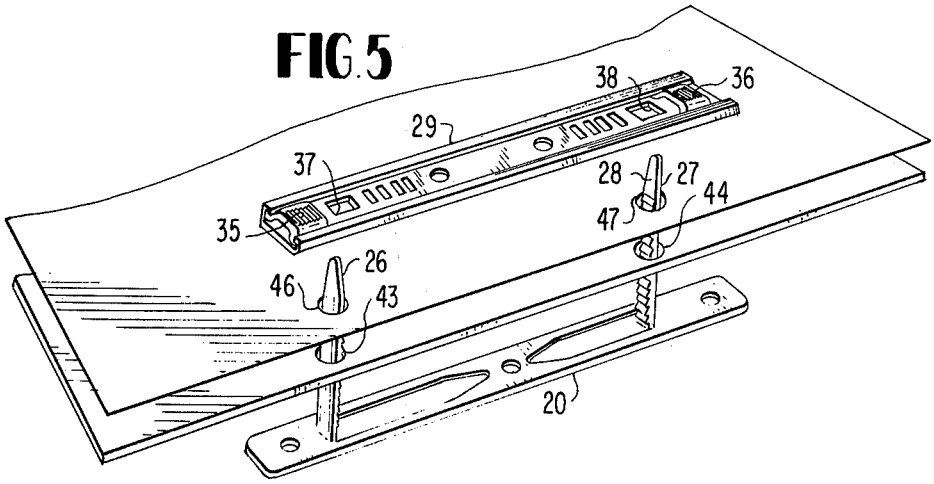

HOLDER FOR LOOSE FILING SHEETS

The invention intends to provide a simple, cheap and convenient holder for securing a sheet of paper or collecting a number of sheets of paper in a sheaf, the sheaf alternatively being fastened into a folder or forming an individual sheaf.

To secure a sheet of paper in a folder or binder, a holding consisting of at least two parts is ordinarily used, one main portion consisting of a flexible metal strip with a middle portion which is attached to the inside of one of the folder covers, while the free end portions of the metal strip form narrow easily bendable tongues which can be bent out to a position at right angles to the middle portion. The distance between the bent-out tongues is the same as the distance between a pair of holes in the edge portion of the respective sheets of paper, so that the sheet can be secured by putting the tongues in the holes. Thereafter the other main portion of the holder is used, this being a locking plate which is applied over the tongues. The locking plate usually consists of a relatively stiff metal strip provided with holes for receiving the tongues. To lock them, the metal tongues are bent down towards the locking plate. Sometimes a more secure lock is desired, especially when the sheaf of papers is relatively thick, and this extra security can be achieved by using a gripping strip or a pair of riders which are pushed onto the locking strip and engage against its edges. The gripping strip or riders then lie over the metal tongues and fix them in their downwardly bent position. Such a holder with flexible tongues which are lockable by means of riders is known, for example from the U.S. patent specification No. 822,147.

Since it is a question of a holder, the parts which are to be manufactured in large series and the manufacturing costs of which should be kept as low as possible, material choice and method of manufacture are of the greatest importance. The known holders usually work with two metal parts, giving rise to correspondingly high material costs.

The object of the invention is therefore to provide a holder consisting of a plastic strip with locking tongues which can be bent upwards, and which are lockable by means of a plastic locking strip and displaceable plastic riders, the invention also intending to provide such a holder which is locked securely even if the sheaf of papers is relatively thick.

This is achieved by a holder which according to the invention has the distinguishing features set forth in the following claims. In a filing folder or binder for sheets of paper, provided with a holder according to the invention, one cover of the binder is provided with holes for the plastic tongues. These are introduced through the holes so that the plastic strip bears against the outside of the normally relatively stiff cover, usually consisting of paperboard or plastic. After putting one or more sheets on the tongues, the locking strip is placed on the tongues. The tongues are then bent down towards each other until they touch the locking strip. Thereafter the riders are pushed on from either end of the locking strip, over the bottom ends of the tongues and towards the ends of the tongues into a position where the riders keep the tongues clamped against the locking strip. Since the tongues on their downwardly facing side are provided with teeth which come into engagement with complementary teeth on the locking strip when the riders press down the tongues against the locking strip, there is accomplished according to the invention a fixed and secure lock which does not glide in spite of the tongues being made of relatively easily flexible plastic having little friction.

These and other advantages and details distinguishing the invention will be explained more closely while referring to an embodiment of the holder according to the invention shown by way of example on the appended drawings.

Figure 7:
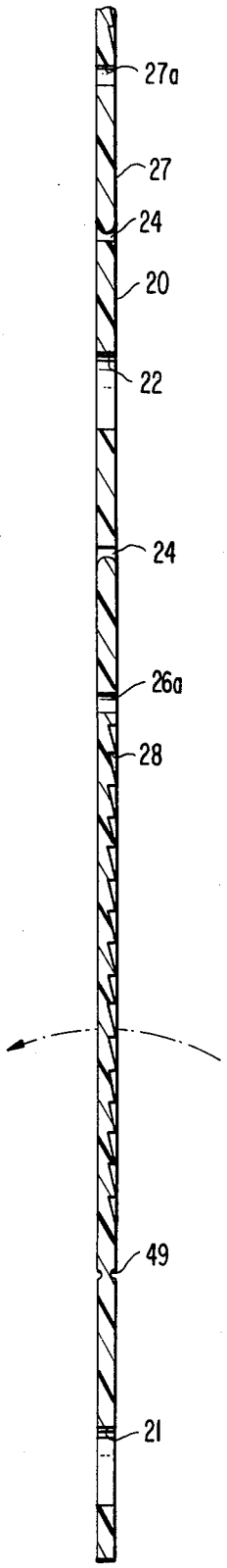
Figure 8:
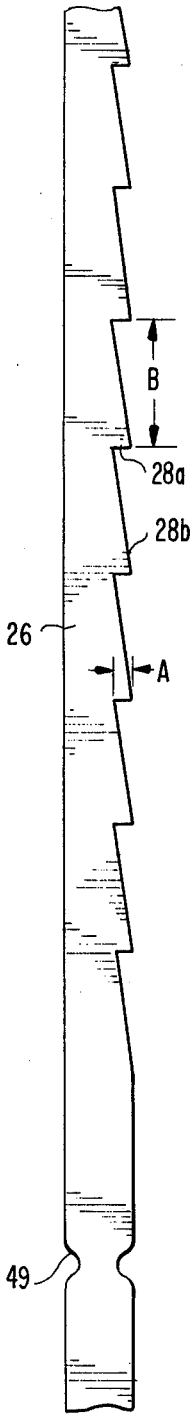
Figure 9:
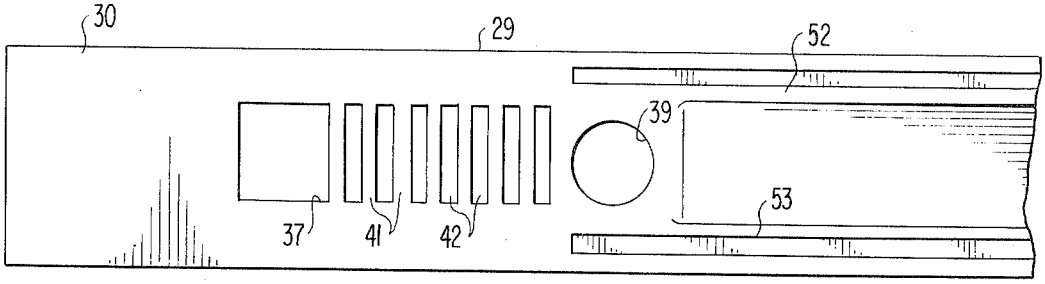
Figure 10:
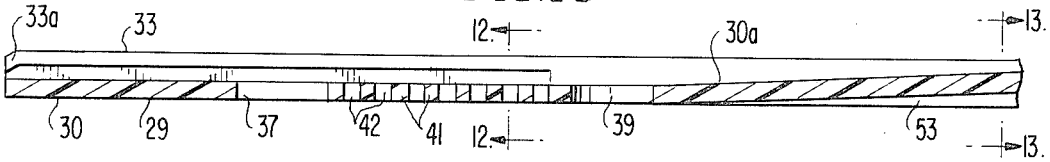
Figure 11:
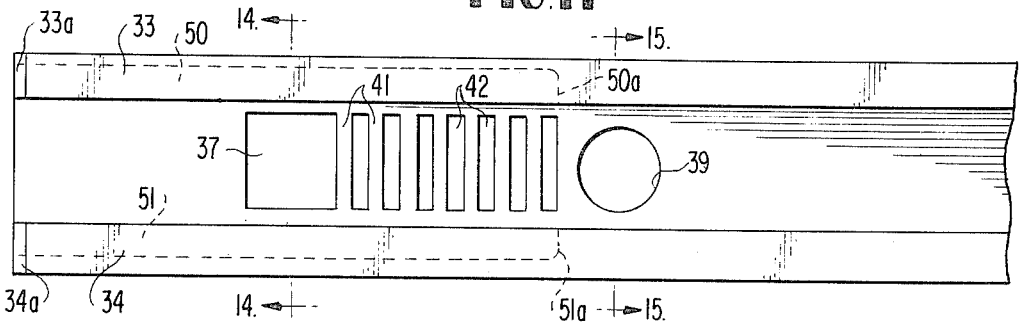
Figure 12:
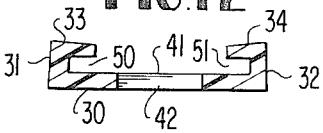
Figure 13:
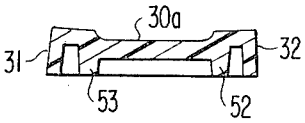
Figure 14:
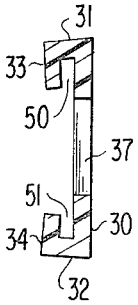
Figure 15:
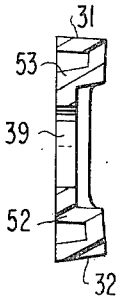
Figure 16:
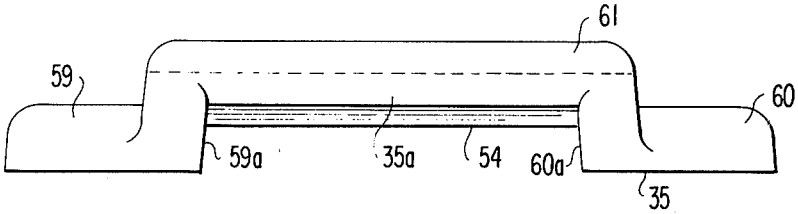
Figure 17:
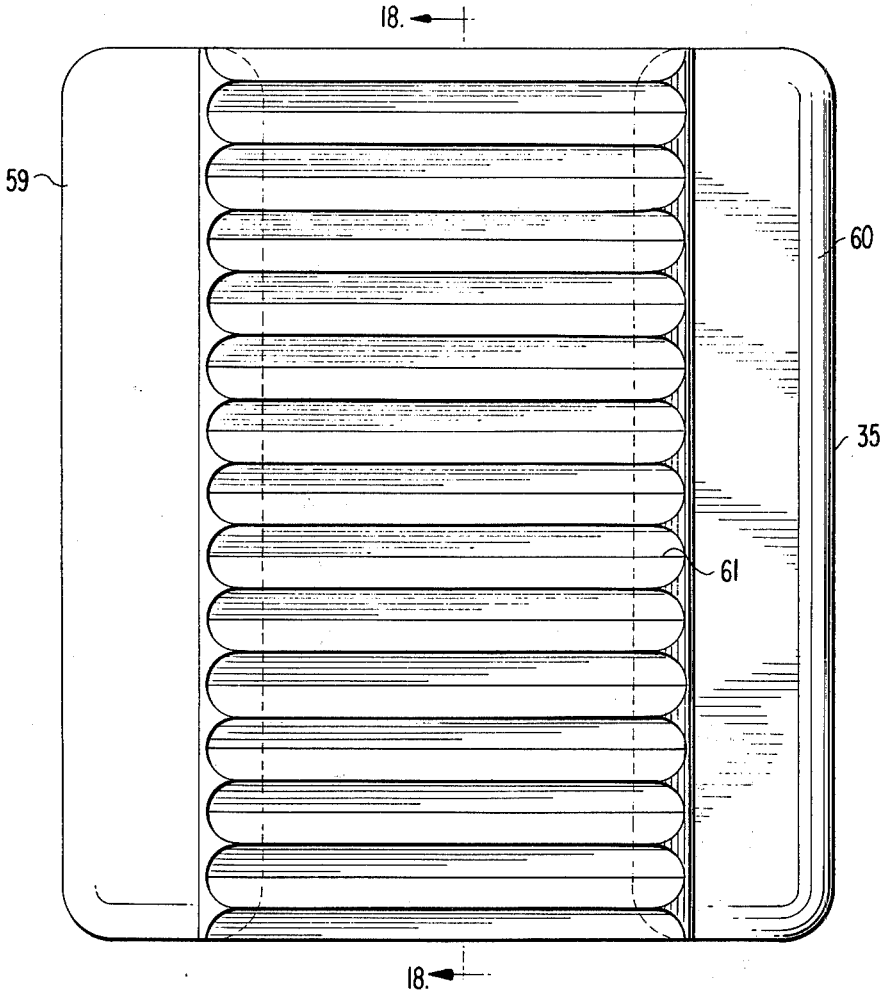
Figure 18:
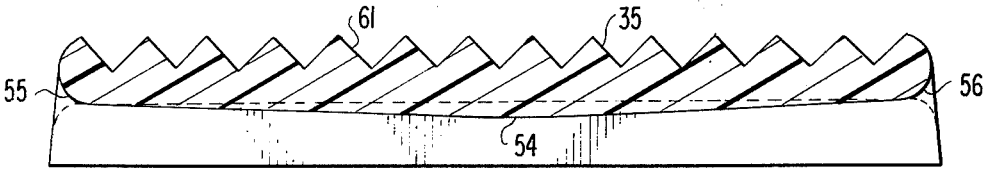
Figure 19:
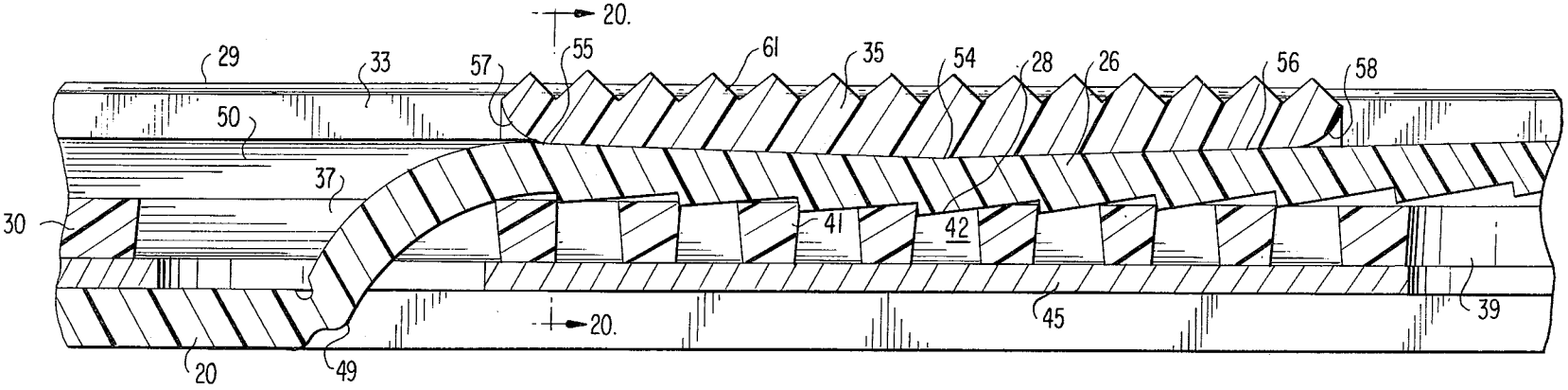
Figure 20:
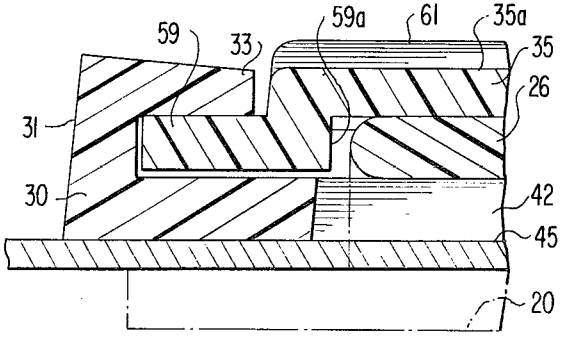
Figure 21:
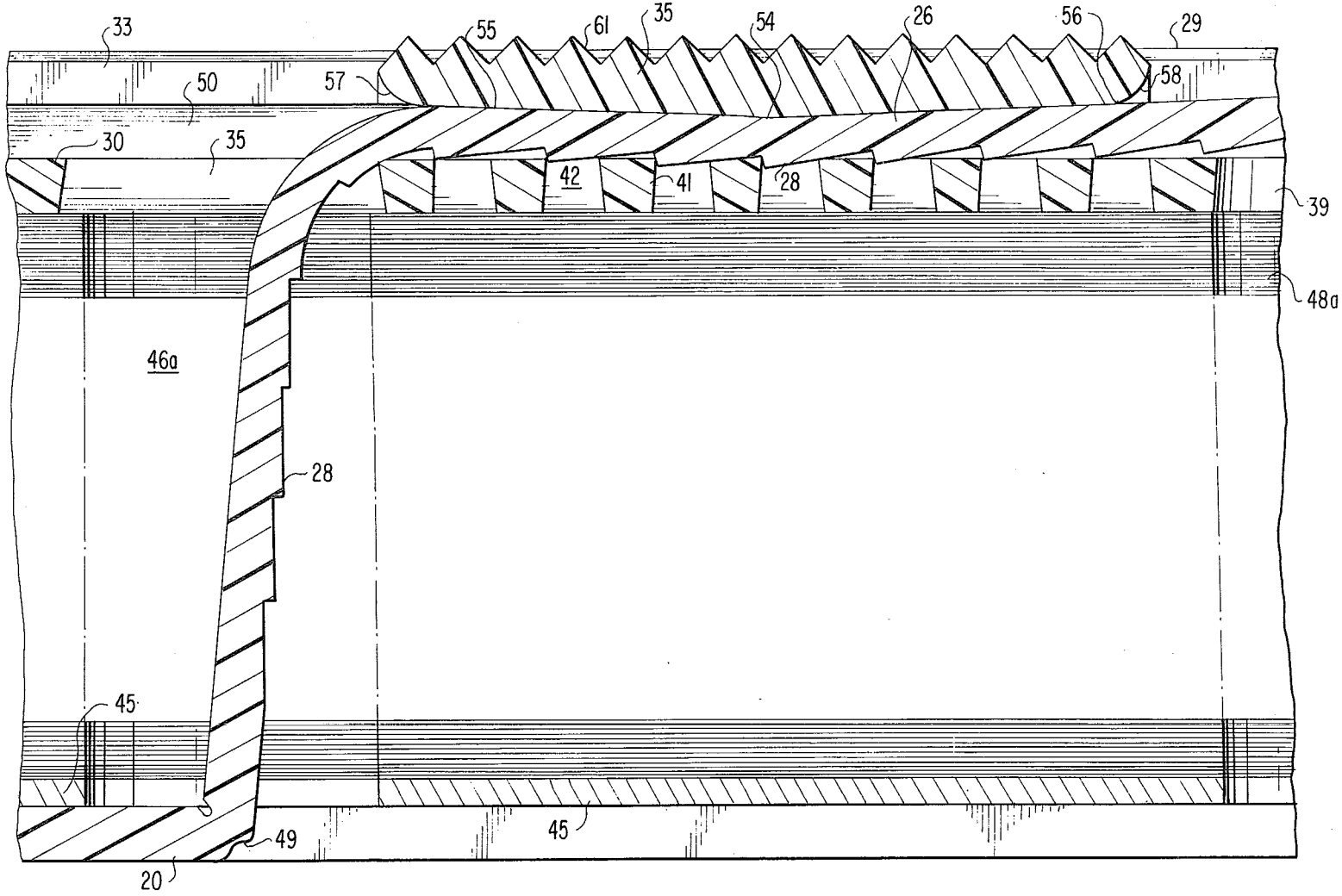

FIG. 1 is a side view of the plastic strip, having two narrow tongues made by cuts in the strip and bent up into the position shown, FIG. 2 shows the same plastic strip an a plan view before the tongues ar bent up to the position in FIG. 1, FIG. 3 is a plan view of the locking strip, FIG. 4 is an end view of the locking strip, FIG. 5 is a schematic exploded perspective view of the two main parts of the holder in combination with a binder cover and a sheet of paper, FIG. 6 is an enlarged plan view of slightly more than half of the plastic strip with the two tongues, FIG. 7 is a longitudinal section through the plastic strip of FIG. 6, FIG. 8 is a still further enlarged side view of a portion of one end of the tongue of the plastic strip, FIG. 9 is an enlarged plan view of a portion of the underside of the locking strip, FIG. 10 is a longitudinal section through the locking strip in FIG. 9, FIG. 11 is a plan view of the upper side of the locking strip in FIG. 9, FIG. 12 is a cross section on the line 12—12 in FIG. 10, FIG. 13 is a cross section on the line 13—13 in FIG. 10, FIG. 14 is a cross section on the line 14—14 in FIG. 11, FIG. 15 is a cross section on the line 15—15 in FIG. 11, FIG. 16 is an enlarged end view of a rider, FIG. 17 is a plan view of the upper side of the rider, FIG. 18 is a longitudinal section of the rider on the line 18—18 in FIG. 17, FIG. 19 is an enlarged longitudinal section through a portion of the holder, and shows how one tongue of the plastic strip is taken through a hole in a binder cover and is locked by the rider with the teeth of the tongue in engagement with the locking teeth of the locking strip, FIG. 20 is a partial section through the holder on the line 20—20 in FIG. 19, and FIG. 21 shows the same section as in FIG. 19 but with a thick sheaf of papers secured between the binder cover and the locking strip.

The plastic strip 20 shown in FIGS. 1 and 2 consists of a flexible plastic material such as polypropene. The strip has three attaching holes 21,22,23 and two V-shaped or U-shaped slits 24,25 with the ends directed towards each other for allowing the formation of two integral corresponding locking tongues 26, 27 having small attaching holes **26*a*, 27*a*** at their ends.

The tongues 26,27 can easily be bent up into a position at right angles to the plastic strip as shown in FIG. 1.

The upper side of the strip and the tongues are smooth, whereas the underside of the tongues is made with locking teeth 28 extending transversely thereof shaped like sawteeth at an even pitch along the greater portion of the length of the tongue. The shape and purpose of the teeth 28 is more closely described in connection with FIGS. 8, 19 and 20.

Apart from the plastic strip 20, there is a second major part incorporated in the holder, i.e. the locking strip 29 shown in FIGS. 3 and 4. This consists of a comparatively hard plastic material such as polystyrene and is shaped as a C-strip with a bottom wall or base 30, two side walls 31,32 and two inwardly directed flanges 33,34 forming two opposing grooves for a pair of riders 35, 36. These riders can be made, for example, by injection moulding a plastic material such as polypropene.

The locking strip 29 has two square holes or openings 37,38 for receiving the locking tongues 26,27 as illustrated in FIG. 5, and it is further provided with two round holes 39,42 for attachment.

Between both openings 37,39 and 38,40, respectively, the upper side of the bottom wall 30 of the locking strip is provided with a plurality of locking teeth 41 lying between plural parallel impressions or slots 42 in the bottom wall 30 of the locking strip that extend perpendicular to the length of the strip and that are spaced apart from each other between holes 37 and 38.

To use the holder, the tongues 26,27 are bent up and inserted in holes 43,44 in a binder cover 45 and through corresponding holes 46,47 in one or several sheets of paper 48, and up through the openings 37,38 in the locking strip. The tongues are thereafter bent down against the bottom wall of the locking strip and the two riders 35,36 are pushed in over either locking tongue, the teeth 28 of the locking tongues thereby latching on the teeth 41 of the locking strip, and are kept securely locked in this position by the riders 35,36.

To form a hinge for bending up the tongues, they are provided at their bases or bottom ends with a crease mark or transverse groove along a transverse line 49 (FIGS. 6–8).

As may be seen from FIGS. 6—8 the teeth 28 of the tongues form a sawtooth configuration with a locking shoulder or flank 28*a* on the underside of the tongue, practically at right angles to the length of the tongue, facing the base of the tongue with a clearance side 28*b* on the tooth forming a relatively small angle with the length of the tongue and extending down to the locking flank of the subsequent tooth at its inward end. To advantage the height A of the teeth is comparatively small in relation to the distance B between the flanks. A suitable distance B is 5–10 times the height A, preferably about 7 times. The thickness of the strip 20 is suitably about one millimeter and the height A of the teeth 28 is accordingly about 0.25 mm.

As may be seen from FIG. 6 the corners of the teeth 28 are rounded off at 28*c* to facilitate the introduction of the teeth into engagement with the teeth 41 of the locking strip.

In FIGS. 9–15 the locking strip 29 is shown without riders. The end portions of the locking strip up to the vicinity of the respective hole 39 and 40 have two opposing guiding grooves between the respective walls 31 and 32 and the bottom wall 30. The grooves extend as far as shoulders 50*a* and 51*a*, which thus form a stop for the distance to which each rider can be pushed onto the strip. At the respective end of the locking strip there is a further stop, e.g. formed by bending down the ends of 33*a*,34*a* of the flanges after introducing the riders, so that these cannot be pulled off the locking strip, and so that when in their outer end position they go free of the openings 37,38.

The bottom wall is raised to form a middle portion 30*a* between the openings 39,40 and this is reinforced on its underside by two longitudinal flanges 52,53 so that the middle portion of the locking strip is relatively stiff against bending. The middle portion 30*a* keeps the ends of the tongues approximately in the same plane as the upper side of the locking strip so that the tongues are easily accessible.

The design of the locking strip teeth 41 is apparent from FIGS. 10, 19 and 20. In the bottom wall of the strip there are a plurality of transverse slits or openings 42 at an even pitch, so that the intermediate portions form locking teeth 41. The distance between the locking flanks of the teeth 41 is the same as the pitch of the locking teeth 28 of the tongues, as is apparent from FIG. 19. From this figure it is also apparent that only some of the tongue locking teeth 28 are in complete engagement with the strip locking teeth 41. This has been achieved by the rider 35,36 being longitudinally shaped with a slightly V-shaped underside having a lowest point 54 at the middle, and end portions 55,56 lying higher. The ends 57,58 are rounded off to facilitate pushing the rider over the tongue 26.

With this design of the rider a comparatively large compressive force on the tongue 26 can be achieved in a limited area around some teeth 41 for providing a secure lock, simultaneously as the resistance to displacement of the rider is kept at a confortable value.

As is apparent from FIGS. 16–18, the rider is U-shaped with outwardly directed edge flanges 59,60 running in the guiding grooves 50,51 of the locking strip. The upper wall 35*a* of the rider is provided on top with fluting or knurling 61 for obtaining an easy grip on the rider when it is being pushed.

The inner sides 59*a* and 60*a* of the flanges form edge guides for the tongue when the rider is pushed over it. The height between the upper side of the locking strip and the underside of the rider at the lowest point 54 is the same as the thickness of the tongue or slightly less, so that a certain amount of deflection is obtained in the flanges 59,60, giving rise to a corresponding clamping pressure against the tongue. In spite of the tongue being comparatively easily flexible, the riders can be pushed in without bending up the tongue, since they are pushed in place from the bottom end of the respective tongue.

FIG. 21 shows finally how a thick sheaf 48*a* of paper is kept securely between the binder cover 45 and the locking strip 29. The holes in the sheaf of paper for the tongue 35 are designated 46*a*.

Since the locking tongue 26 is sawtoothed, the teeth 28 on its underside engaging with the teeth 41 of the locking strip and the rider 35 locally provides a relatively heavy locking pressure, an extremely positive lock of the tongue 26 is ensured, in spite of the relatively large forces which can affect the holder due to the thick sheaf of paper.

If the plastic strip is to be used separately, i.e. without a binder cover, it is advantageous to reinforce it by pushing it into a stiff U-strip with edges wrapping over its edges, thus forming a rigid unit from the two parts.

What I claim is:

1. A holder for punched sheets, comprising a plastic strip, slits in the plastic strip that define integral tongues adapted to be bend up out of the plane of the strip to enter the punched sheets, a locking strip having a bottom wall and side walls and holes through said bottom wall for receiving said tongues, ridlers that are slidable along the locking strip between said side walls and above said bottom wall to retain said tongues in bent down position over said bottom wall and between said side walls, said locking strip having a plurality of parallel elongated slots therethrough that extend perpendicular to the length of the strip and that are spaced apart from each other between said holes, each said tongue having a plurality of locking teeth on the underside thereof, each said tooth extending transversely of its associated said tongue, said teeth being spaced apart from each other at the same interval as said slots, each said tooth having a locking shoulder substantially perpendicular to the plane of the tongue facing the base of its said tongue and a clearance side forming a relatively small angle with the plane of the tongue and extending from the base of the tooth toward the base of its said tongue thereby to permit free movement of each tongue through its associated hole and along said locking strip with said clearance sides sliding over said bottom wall of said locking strip in a direction toward the other said tongue, but to prevent return movement of each tongue through said associated hole when a said rider overlies a said tongue and forces said teeth into said slots, the distance between the bottom wall of the locking strip against which the tongue engages and the underside of the rider that contacts the tongue being approximately equal to the thickness of the tongue to maintain engagement between said teeth and said slots, each said rider having an underside whose profile in longitudinal section is slightly V-shaped having a lowest point at the middle thereof, whereby the greatest compressive force is exerted by the rider on the tongue adjacent the midpoint of the rider, each said tongue having a transverse groove therein that extends full width of the tongue at the base of the tongue, whereby the thickness of the tongue at the base of the tongue is less than the thickness of the plastic strip with which the tongue is integral, thereby to facilitate bending of the tongue at the base thereof.

* * * * *